United States Patent [19]

Shibuya et al.

[11] 4,018,577

[45] Apr. 19, 1977

[54] PARTICLE CHARGING DEVICE FOR USE IN AN ELECTRIC DUST COLLECTING APPARATUS

[75] Inventors: Akira Shibuya, Koganei; Yoshifumi Nitta, Yokohama, both of Japan

[73] Assignee: Ishikawajima-Harima Jukogyo Kabushiki Kaisha, Tokyo, Japan

[22] Filed: Apr. 15, 1974

[21] Appl. No.: 460,762

[30] Foreign Application Priority Data

Apr. 23, 1973 Japan ..... 48-45065

[52] U.S. Cl. ..... 55/137; 55/123; 55/138; 55/139; 55/154

[51] Int. Cl.[2] ..... B03C 3/38

[58] Field of Search ..... 55/2, 123, 128, 129, 55/130, 136, 137, 138, 139, 150, 151, 152, 154

[56] References Cited

UNITED STATES PATENTS

| | | | |
|---|---|---|---|
| 1,959,374 | 5/1934 | Lissman | 55/2 |
| 1,976,214 | 10/1934 | Brion et al. | 55/137 X |
| 2,039,094 | 4/1936 | Lissman | 55/137 |
| 2,085,735 | 7/1937 | Brion et al. | 55/137 |
| 2,086,063 | 7/1937 | Brion et al. | 55/139 X |
| 2,440,455 | 4/1948 | White | 55/139 X |
| 2,509,548 | 5/1950 | White | 55/2 UX |
| 2,698,669 | 1/1955 | Wintermute | 55/152 X |
| 2,987,137 | 6/1961 | Brixius et al. | 55/138 |
| 3,629,656 | 12/1971 | Willig | 55/128 X |
| 3,650,092 | 3/1972 | Gourdine et al. | 55/137 X |
| 3,739,552 | 6/1973 | Webster et al. | 55/123 |
| 3,747,299 | 7/1973 | Chiang | 55/150 X |
| 3,803,808 | 4/1974 | Shibuya et al. | 55/129 X |

FOREIGN PATENTS OR APPLICATIONS

| | | | |
|---|---|---|---|
| 183,768 | 8/1922 | United Kingdom | 55/139 |

*Primary Examiner*—Frank W. Lutter
*Assistant Examiner*—Kathleen J. Prunner
*Attorney, Agent, or Firm*—Price, Heneveld, Huizenga & Cooper

[57] ABSTRACT

A particle charging device for use in a two-stage type of electric dust collecting apparatus, including opposite electrodes disposed at such positions that an intermittent ion generating zone is established between the opposite electrodes and ion generating electrodes, and that uneven, non-uniform electric fields are established between said opposite electrodes and transfer electrodes; a dust containing gas is ionized in the intermittent ion generating zone, and upon transferring the ions by means of the uneven electric field, said ions are brought in contact with a flow of particles in said dust containing gas to thereby charge said particles.

2 Claims, 5 Drawing Figures

PARTICLE CHARGING DEVICE FOR USE IN AN ELECTRIC DUST COLLECTING APPARATUS

BACKGROUND OF THE INVENTION

The present invention relates to an electric dust collecting apparatus, and more particularly, to improvements in a charging section in a two-stage type of electric dust collecting apparatus consisting of a charging section and a dust collecting section, and the invention provides a charging device for dust or a type having a higher electric resistance than has been heretofore considered possible to charge.

Among the conventional dust collectors, a so-called two-stage type of electric dust collector is known, which comprises a charging section for mainly causing the dust to be charged and a dust collecting section for mainly collecting the charged dust.

In the above-mentioned prior art type of charging section, an electrode arrangement in which a group of discharge electrodes consisting of wires or barbed conductor rods are insulatively disposed on the middle plane in the space gap between adjacent ones of a group of opposite electrodes consisting of parallel planar plates arranged in parallel to each other at an equal distance, has been mostly employed. However, the particle charging device having such an electrode arrangement could not obviate the basic technical difficulties that, firstly, insufficiently charged particles are produced, owing to space unevenness of an ion flow, and secondly, when the electric resistance of the dust is extremely high and exceeds $10^{11}$ ($\Omega$/cm), the dust loses its electric charge owing to inverse ionization caused by an accumulated dust layer on the opposite electrodes, whereby the particles vent at the downstream end conveyed by the gas, and consequently, the charging effect was greatly degraded and the dust collecting efficiency as a whole was limited in practice. More particularly, with regard to the aforementioned second shortcoming, it is caused, as described above, by the fact that the electric resistance of the dust layer deposited and accumulated on the opposite electrode becomes extremely high, in fact, to such an extent that the electric field therein exceeds a field breakdown intensity. When this happens, a breakdown occurs within the dust layer producing inverse ionization points on the dust layer from which are fed ions of opposite polarity to the ions fed from the discharge electrode. As a result, these opposite polarity ions neutralize the particle charge. These particles, having lost their charge, are conveyed by the gas and enter the dust collecting section.

In view of the aforementioned shortcomings in the prior art, the inventors of the subject invention tried experiments employing cylindrical rod-shaped electrodes as opposite electrodes, but even in such a case, satisfactory results could not always be obtained in a charging device for an exhaust gas containing dust having a high electric resistance. This was because when a dust layer was formed on the surface of the rod, inverse ionization occurred in the case of a high electric current density.

SUMMARY OF THE INVENTION

It is an object of the present invention to provide a particle charging device which is capable of strongly and uniformly charging particles floating in a dust containing gas, and which is especially suitable for use in a particle charging section in a two-stage type of electric dust collecting apparatus.

Another object of the present invention is to prevent inverse ionization phenomena on the high resistance dust layer deposited on the electrode surface.

A structure most suitable for these objects is a particle charging device for use in an electric dust collecting apparatus comprising an ion generating zone including ion generating electrodes and opposite electrodes for intermittently generating ions between said ion generating electrodes and said opposite electrodes, and transfer electrodes for establishing uneven, i.e., non-uniform, electric fields between said opposite electrodes in the ion generating zone and said transfer electrodes and also transferring ions generated in said ion generating zone.

These and other features and objects of the present invention will be understood in more detail by the following description of the invention with reference to the accompanying drawings, wherein:

DETAILED DESCRIPTION OF THE PREFERRED EMBODIMENT

Figure 2:
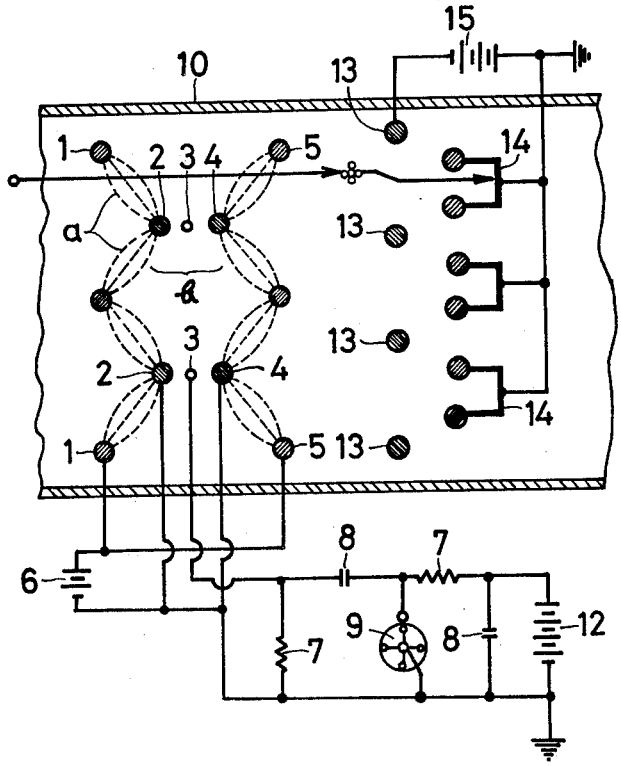
FIG. 2 is an enlarged cross section view taken along line II—II in FIG. 1.

In the drawings, reference numeral 1 designates front stage transfer electrodes disposed upstream in a dust containing gas flowing through a main body 10 of an electric dust collector for establishing transfer electric fields. Body or housing 10 includes a gas inlet 20 and a gas outlet 22 and defines a gas flow path between the inlet and outlet. Reference numerals 2 and 4 designate oppositely charged electrodes positioned downstream of said front stage transfer electrodes 1 and disposed respectively before and behind ion generating electrodes 3 so as to sandwich said electrodes 3 therebetween for establishing an intermittent ion generating zone *b*. Electrodes 3 were spaced approximately 50 mm from electrodes 2 and 4 in one embodiment. The electrode arrangement is constructed in such a manner that the opposite electrodes 2 and the front stage transfer electrodes 1 are disposed in a zigzag or staggered form, and spaced approximately 100 mm from each other. The other opposite electrodes 4 and rear stage transfer electrodes 5, provided at the downstream end of the charging section, are also disposed in a zigzag or staggered form and similarly spaced. The spaced transfer electrodes 1 and 5 define spaced rows of electrodes at opposite ends of the charging section. The spaced rows of opposite electrodes 2 and 4 respectively are positioned between and spaced from the transfer electrode rows. The ion generating electrodes 3 are in turn spaced from and positioned between the opposite electrodes. Each of these electrodes extends across the flowpath of gas through housing 10 with the transfer electrodes 1 and 5 being staggered and positioned between the opposite electrodes 2 and 4 respectively. Electrodes 2, 3 and 4 define electrode means when coupled to power supply 9 provide the generation of ions by the ionization of gas flowing through the housing. The ions are then attracted to the transfer electrodes 1 and 5 to expose the incoming flow of dust particles to a curtain of ions. Reference numeral 6 designates a 50 kv D.C. power supply for establishing transfer electric fields *a*, whose positive pole is connected to the transfer electrodes 1 and 5, and whose negative pole is connected to the opposite electrodes 2 and 4 and also grounded. The ion generating electrodes 3 are coupled to a pulse generator 9 such that a pulse-shaped voltage is applied between said electrodes 3 and the grounded opposite electrodes 2 and 4. The output voltage of generator 9 is negative pulses having a frequency of 50–300 Hz and a peak amplitude of from 10–14 kv. Generator 9 is of conventional design and is actuated by a D.C. voltage source 12 sufficient to provide the peak amplitude of 10–14 kv when coupled to the circuit shown in FIG. 2. Source 12 supplies voltage to electrodes 3 by a resistive capacitive network consisting of elements 7 and 8 coupled as seen in FIG. 2.

It is to be noted that as an alternative, simple method to replace the pulsing method, either an A.C. voltage or a half-wave rectified voltage of negative polarity may be applied to the ion generating electrodes 3 with respect to the ground potential.

In the particle charging device constructed as described above, uneven (i.e., non-uniform) time varying electric fields *a* are formed between the respective front and rear stage transfer electrodes 1 and 5 and the respective opposite electrodes 2 and 4, by passing pulse-shaped electric currents between the ion generating electrodes 3 and the opposite electrodes 2 and 4 ionizing the gas medium between these electrodes. The thus generated negative ions are introduced into the uneven electric fields established between the transfer electrodes 1 and the opposite electrodes 2, and between the transfer electrodes 5 and the opposite electrodes 4, respectively, to transfer said negative ions towards the transfer electrodes 1 in the front stage and towards the transfer electrodes 5 in the rear stage respectively. Thereby, the dust containing gas flow and the negative ions are brought in contact with each other in parallel and non-parallel flows, resulting in efficient negative charging of the dust particles.

The negative charged particles which have passed through the charging section are introduced into a dust collecting section including field forming electrodes 13 and collector electrodes 14 provided in the rear stage of the dust collector body. Here the dust is collected and removed from the gas flow owing to either the space interception effect due to an electric force and the induced adsorption effect towards the pockets of the collector electrodes, or else owing to the combination of both effects. Thus, the flowing gas is discharged to the next stage of the treatment process or to the atmosphere after being converted into a clean gas, i.e., purged of dust.

While a device of the type in which the dust containing gas and the negative ions make contact in both parallel and non-parallel flows has been explained in connection with the above-described embodiment, the present invention should not be limited to such type of device, since it could be constructed as a device of single flowcontact type employing either parallel or non-parallel flows, so long as the intermittent ion generating zone *b* and the ion transfer electric fields *a* are established. More particularly, if the present invention is embodied as a non-parallel flow-contact type of device, then the type of arrangement in which the transfer electrodes are disposed in the front stage (upstream) and the intermittent ion generating zone *b* is disposed in the rear stage (downstream) is advantageous, and, in this case, in the intermittent ion generating zone *b*, it is desirable to arrange the ion generating electrodes 3 and the opposite electrodes 2 and 4 in alignment and at a right angle to the direction of the gas flow.

Since the device according to the present invention comprises an ion generating zone *b* including ion generating electrodes 3 and opposite electrodes 2 and 4 for intermittently generating ions between said ion generating electrodes 3 and said opposite electrodes 2 and 4, and transfer electrodes 1 and 5 for establishing non-uniform electric fields *a* between said opposite electrodes 2 and 4 forming said ion generating zone *b* and said transfer electrodes 1 and 5 and also for transferring the ions generated in said ion generating zone *b*, a high electric potential is not generated on the high resistance dust layer deposited on the electrode surface. This is in contrast to the electric dust collectors of the prior art in which a corona discharge current is made to flow continuously. Thus, the faults caused by the inverse ionization phenomena can be obviated, whereby dust can be easily charged, and even in the case of dust collection from an exhaust gas where the dust has so high an electric resistance that previously it was considered very difficult to collect the dust, can be readily collected by providing a dust collecting section in the stage or zone behind the device constructed according to the present invention. In addition, in FIG. 2, reference numeral 7 designates resistors, reference numeral 8 designates capacitors, numeral 12 designates a high voltage power supply for the pulse generator. Numeral 15 designates a 60 kv power supply for the dust collecting section.

While the transfer electrodes are formed in a rod-shaped configuration according to the above-described embodiment, the present invention should not be limited to such a configuration. For example, parallel plane plates could be disposed along the flow of gas with a similar effect and advantage. This example of modified embodiment is illustrated in FIG. 3.

Figure 1:
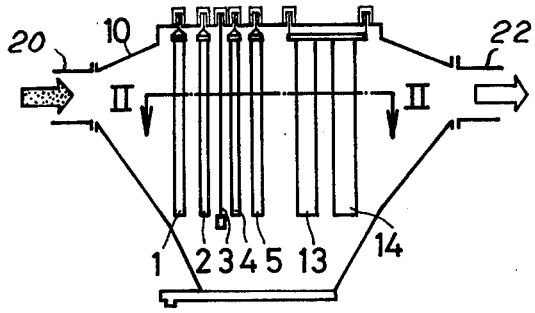
FIG. 1 is a longitudinal cross section view of an electric dust collecting apparatus incorporating one preferred embodiment of the particle charging device according to the present invention.
Figure 3:
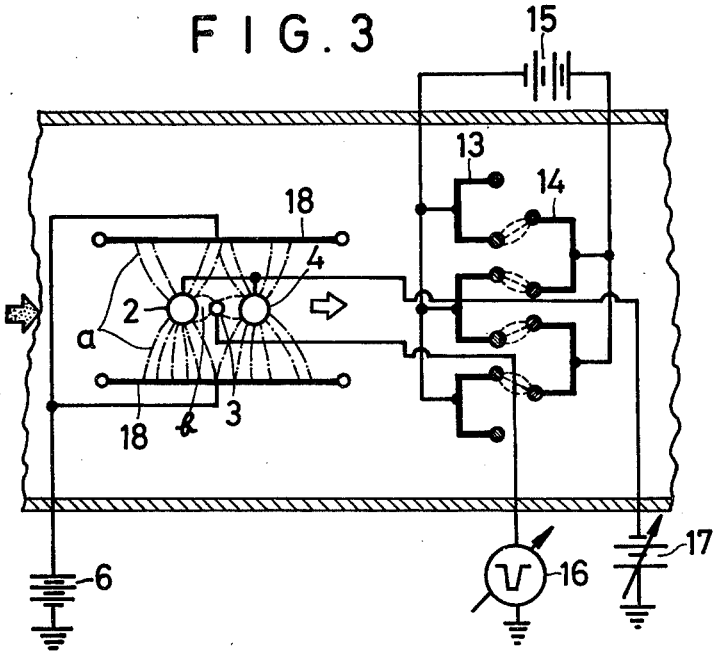
FIG. 3 is an enlarged cross section view of another embodiment of the present invention showing the portion corresponding to that shown in FIG. 2.

In FIG. 3, reference characters *a* and *b* and reference numerals 2, 3, 4, 6, 13, 14 and 15, respectively, designate those parts which correspond to the parts bearing the same reference characters and numerals in FIGS. 1 and 2. Reference numeral 16 designates a pulse generator which can be identical to generator 9. Numeral 17 designates a 5 kv power supply for the opposite electrodes, and numeral 18 designates transfer electrodes in the form of parallel plane plates disposed along the flow of gas.

According to this modified embodiment, the positive pole of the D.C. power supply 6 for establishing transfer electric fields is connected to the transfer electrodes 18 in the form of parallel plane plates, and its negative pole is grounded. In addition, there is provided the adjustable D.C. power supply 17, whose negative pole is connected to the opposite electrodes 2 and 4 and whose positive pole is grounded. Supply 17 applies a voltage to the opposite electrodes 2 and 4 relative to the grounded potential, whereby an electrostatic shielding effect can be controlled and also a corona discharge starting voltage of the ion generating electrodes 3 can be freely controlled.

Figure 4:
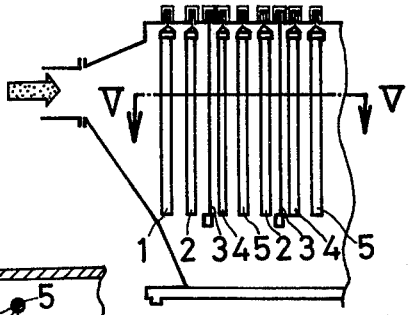
FIG. 4 is a longitudinal cross section view showing a part of still another embodiment of the present invention.
Figure 5:
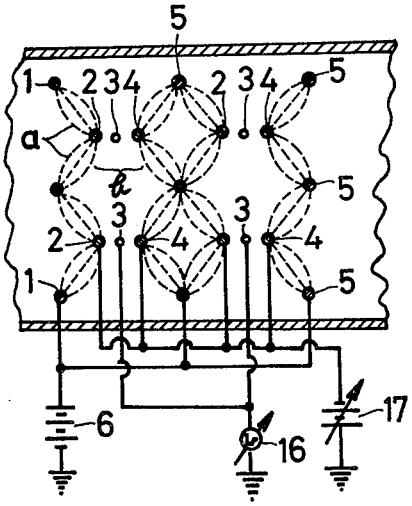
FIG. 5 is an enlarged cross section view taken along line V—V in FIG. 4.

Another modified embodiment of the present invention is illustrated in FIGS. 4 and 5. In these figures, those parts bearing similar reference characters and numerals to those given in FIGS. 1 and 2, correspond to the similarly reference parts in FIGS. 1 and 2, and have the same function as the latter. The only difference between this modified embodiment and the first embodiment in FIGS. 1 and 2 exists in that the particle charging device is disposed in two stages. It is a matter of choice that the particle charging device can be provided in three or more stages. It will become apparent to those skilled in the art that a number of changes to the embodiments disclosed herein can be made without departing from the spirit or scope of the present invention as defined by the appended claims.

The embodiments of the invention in which an exclusive property or privilege is claimed are defined as follows:

1. An electrical dust collecting apparatus comprising:

a housing including a gas inlet at one end for receiving a dust containing gas, and a gas outlet at an end of said housing remote from said inlet;

a charging section positioned in said housing adjacent said one end for electrically charging dust particles entering said inlet, said charging section comprising a plurality of spaced ion generating electrodes positioned in said housing to extend across the flow path of gas through said housing, a plurality of pairs of opposite electrodes positioned in said housing to extend across the flow path of gas through said housing such that each ion generating electrode is positioned intermediate a pair of said opposite electrodes, said opposite electrodes spaced from said ion generating electrodes, a plurality of transfer electrodes positioned in said housing to extend across the flow path of gas through said housing in alternately spaced relationship to said opposite and ion generating electrodes with a first row of transfer electrodes positioned in spaced relationship on the inlet side of said opposite electrodes and a second row of transfer electrodes positioned in spaced relationship on the outlet side of said opposite electrodes, power supply means coupled to said ion generating electrodes to ionize gas between said ion generating electrodes and said opposite electrodes, and additional power supply means coupled between said opposite electrodes and said transfer electrodes for establishing an electric field between said opposite electrodes and said transfer electrodes to attract ions toward said transfer electrodes; and a collecting section positioned in said housing for collecting dust particles electrically charged in said charging section, said collecting section positioned between said charging section and said outlet and including a plurality of spaced field forming electrodes positioned in said housing to extend across the flow path of gas through said housing, a plurality of spaced collector electrodes positioned in said housing on a side of said field forming electrodes spaced toward said outlet, and further power supply means coupled between said field forming electrodes and said collector electrodes for establishing an electrical field therebetween for applying a force to electrically charged dust particles to cause said charged particles to be collected by said collector electrodes.

2. The apparatus as defined in claim 1 wherein said pairs of opposite electrodes lie in a plane including an associated ion generating electrode parallel to the flow of gas through said housing.

* * * * *